US006376844B1

(12) United States Patent
Tasaki et al.

(10) Patent No.: US 6,376,844 B1
(45) Date of Patent: Apr. 23, 2002

(54) STIMULABLE PHOSPHOR SHEET AND PROCESS FOR PRODUCING THE SAME

(75) Inventors: Seiji Tasaki; Katsuhiro Kohda, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/525,480

(22) Filed: Mar. 15, 2000

(30) Foreign Application Priority Data

Mar. 15, 1999 (JP) ..... 11-068963

(51) Int. Cl.[7] ..... G21K 4/00
(52) U.S. Cl. ..... 250/484.4; 250/484.2
(58) Field of Search ..... 250/484.4, 484.3, 250/483.1, 484.2, 486.1, 487.1

(56) References Cited

FOREIGN PATENT DOCUMENTS

DE 3325035 A1 * 1/1985 ..... 250/484.4

* cited by examiner

*Primary Examiner*—Georgia Epps
*Assistant Examiner*—Richard Hanig
(74) *Attorney, Agent, or Firm*—Sughrue Mion, PLLC

(57) ABSTRACT

A stimulable phosphor sheet for a radiation image recording and reproducing method comprising the steps of recording a radiation image as a latent image, irradiating the latent image with stimulating rays to release stimulated emission, and electrically processing the emission to reproduce the radiation image, is preferably composed of a stimulable phosphor-containing grid partition that contains a stimulable phosphor, a UV or visible light-emitting phosphor, or a reflective material and two-dimensionally divides the phosphor sheet on its plane to give plural small rectangular sections, and stimulable phosphor-incorporated areas which are rectangularly sectioned with the grid partition and which have a reflectance at the wavelength of the stimulating rays which differs from that of the grid partition.

18 Claims, 5 Drawing Sheets

STIMULABLE PHOSPHOR SHEET AND PROCESS FOR PRODUCING THE SAME

FIELD OF THE INVENTION

The present invention relates to a stimulable phosphor sheet employable in a radiation image recording and reproducing method utilizing stimulated emission from a stimulable phosphor.

BACKGROUND OF THE INVENTION

As a method replacing a conventional radiography using a combination of a radiographic film and radiographic intensifying screens, a radiation image recording and reproducing method utilizing a stimulable phosphor was proposed and is practically employed. The method employs a radiation image storage panel comprising a stimulable phosphor layer (i.e., stimulable phosphor sheet) provided on a support, and the procedure of the method comprises the steps of causing the stimulable phosphor of the sheet to absorb radiation energy having passed through an object or having radiated from an object; sequentially exciting the stimulable phosphor with an electromagnetic wave such as visible light or infrared rays (hereinafter referred to as "stimulating rays") to release the radiation energy stored in the phosphor as light emission (i.e., stimulated emission); photoelectrically detecting the emitted light to obtain electric signals; and reproducing the radiation image of the object as a visible image from the electric signals. The panel thus processed is subjected to a step for erasing a radiation image remaining therein, and then stored for the next recording and reproducing procedure. Thus, the radiation image storage panel can be repeatedly employed.

In general, a support and a protective film are provided on the top and bottom surfaces of the stimulable phosphor sheet (or layer), respectively. The stimulable phosphor sheet (or layer) generally comprises a binder and stimulable phosphor particles dispersed therein, but it may consist of agglomerated phosphor without binder. The phosphor sheet containing no binder can be formed by deposition process or firing process. Further, the sheet comprising agglomerated phosphor soaked with a polymer is also known. For the aforementioned method, any types of the stimulable phosphor sheets are employable.

The radiation image recorded in the stimulable phosphor sheet is generally read by the steps of applying stimulating rays onto the front surface side (the phosphor layer side) of the phosphor sheet, collecting light emitted by the phosphor particles by means of a light-collecting means from the same side, and photoelectrically converting the light into image signals. A system for reading the image from one side of the panel in this manner is referred to as "single-side reading system". However, there is a case that the light emitted by the phosphor particles should be collected-from both sides (i.e., the front and the back surface sides) of the phosphor sheet. For instance, there is a case that the emitted light is desired to be collected as much as possible. There also is a case that the radiation image recorded in the phosphor layer varies along the depth of the layer, and that it is desired to detect the variation. A system for reading the image from both sides of the phosphor sheet is referred to as "double-side reading system".

The radiation image recording and reproducing method is often used in radiography for medical diagnosis. In that case, it is especially desired to obtain a radiation image of high quality (particularly, high sharpness for high resolution) by applying a small dose of radiation. Therefore, the stimulable phosphor sheet is required to have a high sensitivity and to provide an image of high quality.

The sharpness of radiation image is mainly affected by diffusion or scattering of the stimulating rays in the phosphor sheet or layer. The procedure for reading the latent image comprises the steps of sequentially scanning a beam of the stimulating rays on the surface of the phosphor sheet to induce the stimulated emission, and successively collecting and detecting the emission. If the stimulating rays diffuse or scatter (horizontally in particular) in the sheet, it excites the phosphor not only at the target spot but also in the periphery. Consequently, the stimulated emission emitted from the target position is collected together with that from the periphery. Such contamination of the emissions impairs the sharpness of the resultant image.

For avoiding the diffusion or scattering of the stimulating rays, it has been proposed to divide the plane of the stimulable phosphor sheet into small sections (cells) with a partition reflecting the stimulating ray.

Japanese Patent Provisional Publication No. 59-202100 discloses a stimulable phosphor sheet having a honey-comb structure consisting of many small cells filled with a stimulable phosphor. The panel comprises a substrate and a stimulable phosphor layer provided thereon, and the honey-comb structure, sectioned with a partition is further provided on the phosphor layer.

Japanese Patent Provisional Publication No. 62-36599 discloses a stimulable phosphor sheet employing a support provided with many hollows regularly arranged on one surface. The hollows are filled with a stimulable phosphor, and the ratio of depth to diameter of each hollow is 3.5 or more.

Japanese Patent Provisional Publication No. 5-512636 discloses a process for preparing pixel phosphors with a mold.

Japanese Patent Provisional Publication No. 2-129600 discloses a storage panel employing a support plate having many holes vertically bored and filled with a stimulable phosphor.

Further, Japanese Patent Provisional Publication No. 2-280100 discloses a stimulable phosphor sheet employing a substrate having a honey-comb micro-structure filled with a stimulable phosphor.

In each aforementioned known panel employing a support or substrate provided with many holes or hollows incorporated with a phosphor, a part of the support or substrate serves as a partition preventing the simulating rays from diffusion. That panel, therefore, is useful for improving quality (particularly, sharpness) of the resultant image. On the other hand, since the partition of support material partly occupies the phosphor layer, the amount of the phosphor incorporated in a unit volume of the layer is often too small to absorb enough amount of radiation. Consequently, the partition lowers the sensitivity of the stimulable phosphor sheet. Although the sensitivity can be enhanced by thickening the phosphor layer, a thick phosphor layer generally impairs the sharpness.

In radiography for medical diagnosis, a stimulable phosphor sheet of high sensitivity can reduce a dose of radiation to be applied to a patient. Therefore, it is needed to provide a stimulable phosphor sheet giving an image of higher sharpness with higher sensitivity.

SUMMARY OF THE INVENTION

The invention resides in a stimulable phosphor sheet for a radiation image recording and reproducing method comprising the steps of recording a radiation image as a latent image, irradiating the latent image with stimulating rays to release stimulated emission, and electrically processing the emission to reproduce the radiation image, comprising a stimulable phosphor-containing grid partition that two-dimensionally divides the phosphor sheet on its plane to give plural small rectangular sections, and stimulable phosphor-incorporated areas which are rectangularly sectioned with the grid partition and which have a reflectance at the wavelength of the stimulating rays which differs from that of the grid partition.

The above-mentioned stimulable phosphor sheet of the invention is preferably produced by a process which comprises the steps of:

(i) producing plural stimulable phosphor films A and plural stimulable phosphor films B having a reflectance at the wavelength of the stimulating rays which differs from that of the films A;

(ii) forming a multi-layered composition block in which the stimulable phosphor films A and the stimulable phosphor films B are alternately piled up under the condition that neighboring phosphor films A and B would be placed in close contact with each other;

(iii) repeatedly slicing the multi-layered composition block in the direction perpendicular to the plane of the piled films, to prepare plural striped phosphor films in which strips of the stimulable phosphor films A and B are alternately arranged;

(iv) forming another multi-layered composition block in which the striped phosphor films and the stimulable phosphor films B are alternately piled up under the condition that neighboring striped film and stimulable phosphor film B would be placed in close contact with each other; and, (v) slicing repeatedly the multi-layered composition block formed in the step (iv) in the direction perpendicular to the plane of the piled films, so as to give a stimulable phosphor sheet which comprises a stimulable phosphor-containing grid partition two-dimensionally dividing the phosphor sheet on its plane to give plural small rectangular sections, and stimulable phosphor-incorporated areas which are rectangularly sectioned with the grid partition and which have a reflectance at the wavelength of the stimulating rays which differs from that of the grid partition.

The invention also resides in a stimulable phosphor sheet for a radiation image recording and reproducing method comprising the steps of recording a radiation image as a latent image, irradiating the latent image with stimulating rays to release stimulated emission, and electrically processing the emission to reproduce the radiation image, comprising a grid partition that contains a phosphor absorbing the radiation and emitting light in a UV or visible wavelength region and two-dimensionally divides the phosphor sheet on its plane to give plural small rectangular sections, and stimulable phosphor-incorporated areas which are rectangularly sectioned with the grid partition and which have a reflection property differing from that of the grid partition at the wavelength of the stimulating rays.

The above-mentioned stimulable phosphor sheet of the invention is preferably produced by a process comprising the steps of:

(i) producing plural stimulable phosphor films A and plural phosphor films B which contain a phosphor absorbing the radiation and emitting light in a UV or visible wavelength region and which have a reflectance differing from that of the films A at the wavelength of the stimulating rays;

(ii) forming a multi-layered composition block in which the stimulable phosphor films A and the phosphor films B are alternately piled up under the condition that neighboring phosphor films A and B would be placed in close contact with each other;

(iii) repeatedly slicing the multi-layered composition block in the direction perpendicular to the plane of the piled films, to prepare plural striped phosphor films in which strips of the phosphor films A and B are alternately arranged;

(iv) forming another multi-layered composition block in which the striped phosphor films and the phosphor films B are alternately piled up under the condition that neighboring striped film and phosphor film B would be placed in close contact with each other; and (v) slicing repeatedly the multi-layered composition block formed in the step (iv) in the direction perpendicular to the plane of the piled films, so as to give a stimulable phosphor sheet which comprises a UV or visible light-emitting phosphor-containing grid partition two-dimensionally dividing the phosphor sheet on its plane to give plural small rectangular sections, and stimulable phosphor-incorporated areas which are rectangularly sectioned with the grid partition and which have a reflectance at the wavelength of the stimulating rays which differs from that of the grid partition.

The invention further resides in a process for producing a stimulable phosphor sheet, comprising the steps of:

(i) producing plural stimulable phosphor films A and plural reflective material films B;

(ii) forming a multi-layered composition block in which the stimulable phosphor films A and the reflective material films B are alternately piled up under the condition that neighboring films A and B would be placed in close contact with each other;

(iii) repeatedly slicing the multi-layered composition block in the direction perpendicular to the plane of the piled films, to prepare plural striped phosphor films in which strips of the films A and B are alternately arranged;

(iv) forming another multi-layered composition block in which the striped phosphor films and the reflective material films B are alternately piled up under the condition that neighboring striped film and film B would be placed in close contact with each other; and (v) slicing repeatedly the multi-layered composition block formed in the step (iv) in the direction perpendicular to the plane of the piled films, so as to give a stimulable phosphor sheet which comprises a reflective material-containing grid partition two-dimensionally dividing the phosphor sheet on its plane to give plural small rectangular sections, and stimulable phosphor-incorporated areas which are rectangularly sectioned with the grid partition.

In the stimulable phosphor sheet of the invention, the stimulable phosphor-incorporated areas preferably contain at least stimulable phosphor particles and a binder. The stimulable phosphor-containing grid partition preferably contains stimulable phosphor particles and a binder. The phosphor-containing grid partition may preferably contain a binder and phosphor particles absorbing the radiation and emitting light in a UV or visible wavelength region. Otherwise, the grid partition may preferably contain light-reflecting particles and a binder.

The phosphor sheet of the invention preferably has a layer of reflecting the stimulating rays or stimulated emission, which is provided on the surface opposite to the surface on which the stimulating rays are applied. The top and the bottom of the partition may exposed on the surface of the phosphor sheet, or both or one of them may be buried under the phosphor sheet. Preferably, the height of the partition is in the range of 1/3 to 1/1 of the thickness of the phosphor sheet.

Since the stimulable phosphor sheet of the invention gives an image of high sharpness with high sensitivity in the radiation image recording and reproducing method, it is very appropriate to employ the stimulable phosphor sheet of the invention for radiographic medical diagnosis. Further, that stimulable phosphor sheet can be easily, precisely and efficiently produced by the process of the invention.

BRIEF DESCRIPTION OF DRAWINGS

FIG. 4 illustrates the step for forming a multi-layered composition from the films A and B of FIG. 3.

FIG. 5 illustrates the step for forming a multi-layered composition block from the multi-layered composition of FIG. 4.

FIG. 6 illustrates the step for slicing the multi-layered composition block of FIG. 5, to produce striped phosphor films.

FIG. 7 shows the striped phosphor film produced in the step of FIG. 6.

FIG. 8 illustrates the step for forming a multi-layered composition from the striped phosphor films of FIG. 7 and the films B (for the grid partition).

FIG. 9 illustrates the step for slicing the multi-layered composition block of FIG. 8, to produce the stimulable phosphor sheets of the invention having a plane sectioned with the grid partition.

DETAILED DESCRIPTION OF THE INVENTION

Figure 1:
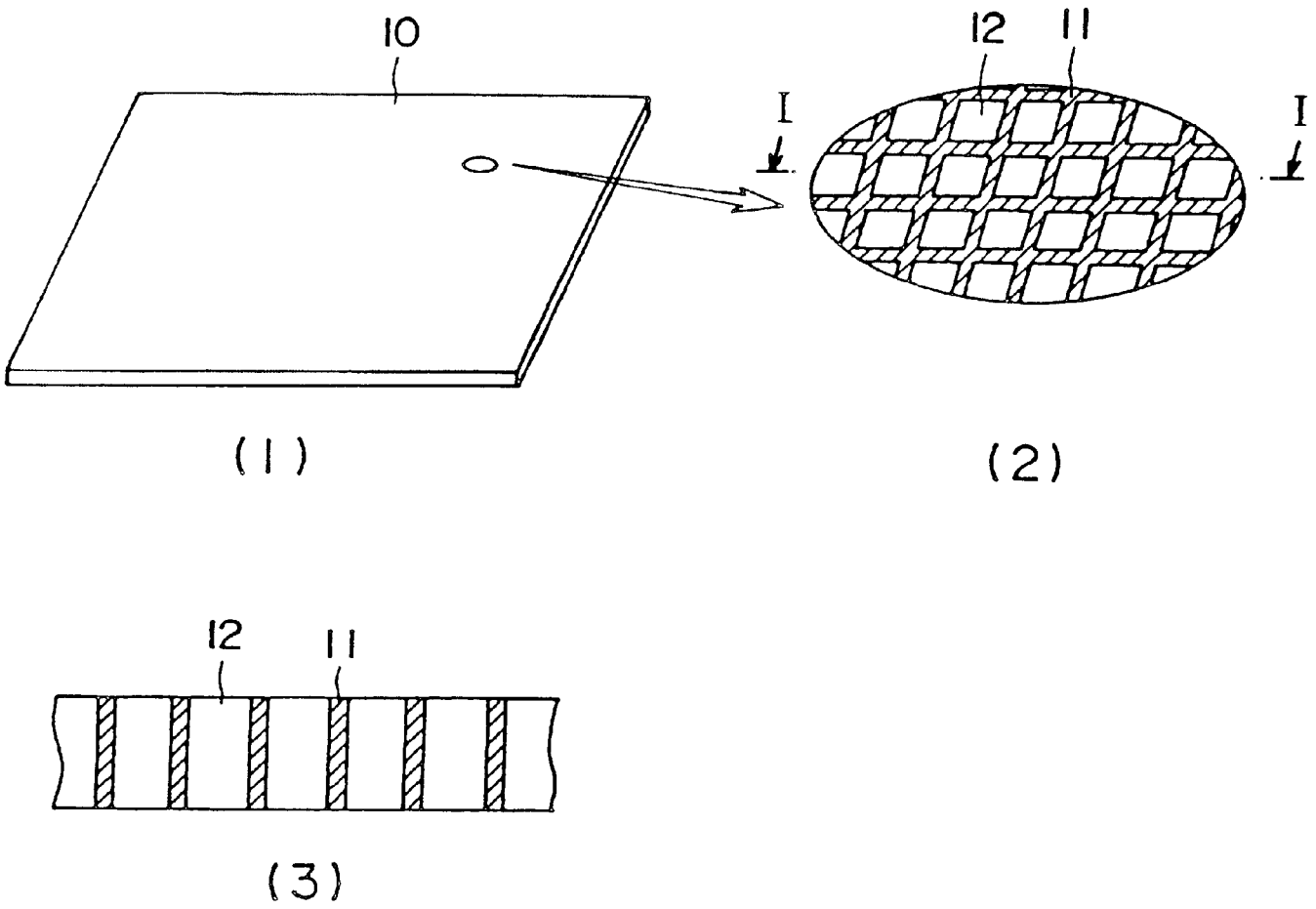
FIGS. 1-(1), -(2) and -(3) illustrate a stimulable phosphor sheet of the invention, a partial enlarged view of (1) and a partial sectional view of (2) sectioned with I—I line, respectively.

The stimulable phosphor sheet of the invention is used in the radiation image recording and reproducing method described above, and is characterized by basically comprising a partition two-dimensionally dividing the plane of the stimulable phosphor sheet into small sections and stimulable phosphor-incorporated areas sectioned with that partition. The stimulable phosphor-incorporated areas have a reflection property (reflectance) differing from that of the partition at the wavelength of the stimulating rays. The partition is in the form of a grid to divide the plane into rectangular sections (i.e., rectangular stimulable phosphor-incorporated areas), and contains a stimulable phosphor or a UV-emitting phosphor (which absorbs the radiation and emits light in a UV or visible wavelength region). The partition containing a stimulable phosphor and the partition containing a UV-emitting phosphor are often referred to as "stimulable phosphor-containing partition" and "UV-emitting phosphor-containing partition", respectively. Since the partition containing each phosphor prevents the simulating rays from diffusion or scattering in the phosphor sheet without impairing the sensitivity, the stimulable phosphor sheet of the invention gives an image of high sharpness with high sensitivity.

From the viewpoint of fundamental performance, it is not necessary for the stimulable phosphor sheet of the invention to have a protective film and a support. The stimulable phosphor sheet, however, is preferably provided with them for ensuring safety in transportation and for avoiding deterioration, and hence a typical embodiment of the stimulable phosphor sheet of the invention comprises a support and a protective film on the bottom and on the top surface, respectively. By taking an example of the stimulable phosphor sheet having that structure (which is often referred to as "radiation image storage panel"), the invention is described below. In the following description, the stimulable phosphor sheet in the radiation image storage panel is often referred to as "stimulable phosphor layer" or simply "phosphor layer".

As the support, a sheet or a film of flexible resin material having a thickness of 50 $\mu$m to 1 mm is usually employed. The support may be transparent or may contain light-reflecting material (e.g., titanium dioxide particles, barium sulfate particles) or voids for reflecting the stimulating rays or the stimulated emission. Further, it may contain light-absorbing material (e.g., carbon black) for absorbing the stimulating rays or the stimulated emission. Examples of the resin materials include polyethylene terephthalate, polyethylene naphthalate, aramid resin and polyimide resin. The support may be a sheet of other material such as metal, ceramics and glass, if needed. On the phosphor sheet-side surface of the support, auxiliary layers (e.g., light-reflecting layer, light-absorbing layer, adhesive layer, electro-conductive layer) or many hollows may be provided. On the other side surface, a friction-reducing layer or an anti-scratch layer may be formed.

The stimulable phosphor layer (sheet) is provided on the support. The phosphor sheet according to the invention comprises the stimulable phosphor or UV-emitting phosphor-containing grid partition which divides two-dimensionally the plane of the sheet into small rectangular sections, and the stimulable phosphor-incorporated areas which are rectangularly sectioned with the grid partition and which have a reflectance differing from that of the grid partition at the wavelength of the stimulating rays. By referring to the attached drawings, the stimulable phosphor layer (sheet) having the aforementioned structure is described below.

FIGS. 1-(1), -(2) and -(3) are sketchs showing a stimulable phosphor sheet 10 of the invention, a partial enlarged view of (1) and a partial sectional view of (2) sectioned with I—I line, respectively. The shadowed portion in (2) and (3) indicates the stimulable or UV-emitting phosphor-containing grid partition 11, and the parts surrounded with the shadowed portion are the stimulable phosphor-incorporated areas 12. The thickness of the phosphor sheet (layer) is generally in the range of 20 $\mu$m to 1 mm, preferably 50 $\mu$m to 500 $\mu$m. Preferably, the width of the partition is in the range of 5 $\mu$m to 50 $\mu$m, and each stimulable phosphor-incorporated area 12 has a width (in plane direction) of 20 $\mu$m to 200 $\mu$m on average.

The top and the bottom of the partition in FIG. 1 appear on the surfaces of the sheet, but both or one of them may be buried under the phosphor sheet. Preferably, the height of the grid partition is in the range of 1/3 to 1/1 of the thickness of the phosphor sheet.

Figure 2:
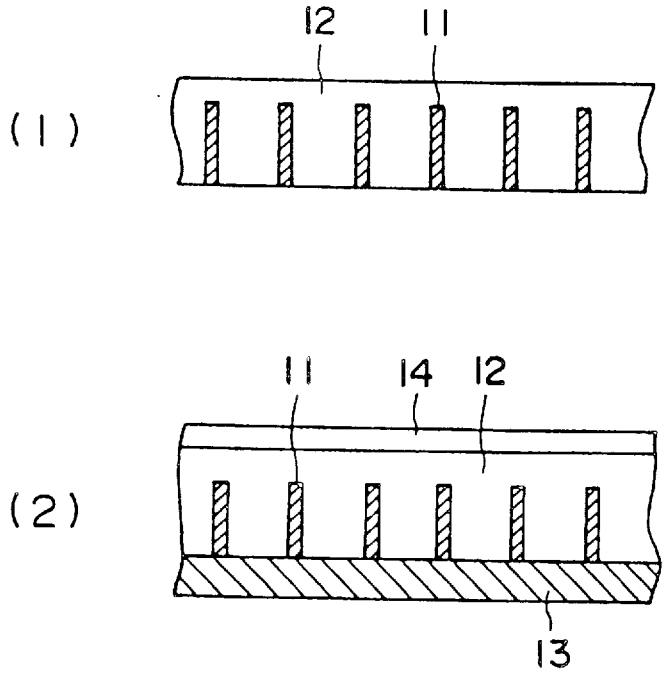
FIG. 2-(1) shows a sectional view of another embodiment of the invention, and FIG. 2-(2) is a sectional view of the stimulable phosphor sheet of (1) provided with a protective film and a support on the top and the bottom surfaces, respectively.

FIG. 2-(1) shows a sectional view of another stimulable phosphor sheet of the invention in which the top of the partition is buried under the phosphor sheet. FIG. 2-(2) is a sectional view of the sheet of (1) provided with a support 13 and a protective film 14 on the bottom and the top surfaces, respectively.

As the stimulable phosphor incorporated in the stimulable phosphor-containing grid partition and the stimulable phosphor-incorporated areas, a phosphor giving a stimulated emission of a wavelength in the range of 300 to 500 nm when it is irradiated with stimulating rays of a wavelength in the range of 400 to 900 nm is preferably employed. In Japanese Patent Provisional Publications No. 2-193100 and No. 4-310900, some examples of the stimulable phosphor are described in detail. Examples of the preferred phosphors include divalent europium or cerium activated alkaline earth metal halide phosphors (e.g., BaFBr:Eu, BaFBrI:Eu), and cerium activated oxyhalide phosphors. The stimulable phosphor in the partition and that in the phosphor-incorporated areas may be the same or different from each other, and usually are the same. Further, they may differ in composition but emit light in the same wavelength region when they are excited with stimulating rays of the same wavelength.

As the UV-emitting phosphor incorporated in the UV-emitting phosphor-containing partition, a phosphor giving an emission peak in a UV or visible (preferably, UV) wavelength region is employed. In more detail, a phosphor absorbing a radiation of a wavelength not longer than 250 nm and immediately emitting light in the wavelength region of 250 to 400 nm (UV wavelength region) is preferably employed. Examples of the U-emitting phosphors include $YTaO_4$, $YTaO_4$:Gd, LnOX:Ac (in which Ln is Y, La, Gd and/or Lu; X is Cl, Br and/or I; Ac is Bi and/or Gd), $LnF_3$:Ce (in which Ln is Y, La, Gd and/or Lu), $GdF_3$, and $BaF_2$. Further, UV light-emitting phosphors described in Japanese Patent Provisional Publication No. 2-176600 are also employable.

The stimulable or UV light-emitting phosphor is usually used in the form of particles. The phosphor particles and a binder are well mixed in an appropriate solvent to prepare a coating dispersion. In the coating dispersion, the binder and the phosphor are introduced generally at a ratio of 1:1 to 1:100 (binder:phosphor, by weight), preferably 1:8 to 1:40 (by weight). As the binder material, various known resins are employable for forming the stimulable phosphor-incorporated areas, the stimulable phosphor-containing grid partition, or the UV light-emitting phosphor-containing grid partition.

The stimulable phosphor sheet of the invention comprises the stimulable or UV light-emitting phosphor-containing grid partition which two-dimensionally divides the plane of the sheet into small sections and stimulable phosphor-incorporated areas which are rectangularly sectioned with the grid partition and which have a reflectance differing from that of the grid partition at the wavelength of the stimulating rays. With respect to the difference of reflectance, there are two cases:

(1) the phosphor-incorporated area has a reflectance lower than that of the partition at the wavelength of the stimulating rays, and (2) the phosphor-incorporated area has a reflectance higher than that of the partition at the wavelength of the stimulating rays.

The stimulable phosphor sheet of the embodiment (1) is preferred when a radiation image of particularly high sharpness is required.

The reflectance of the phosphor-incorporated areas and that of the grid partition at the wavelength of the stimulating rays can be made higher by various methods. For example, the reflectance can be increased by relatively increasing the weight ratio of phosphor/binder, by relatively reducing the size (i.e., mean particle size) of the phosphor particles (i.e., by using fine particles of the phosphor), or by incorporating white pigments (e.g., titanium dioxide, barium sulfate) or stimulating ray-reflecting particles (e.g., phosphor particles other than the stimulable or UV light-emitting phosphor). These methods can be adopted singly or in combination. Further, a stimulating ray-reflecting thin film may be provided between the partition and the phosphor-incorporated areas.

The reflectance at the wavelength of the stimulating rays can be made lower by, for example, relatively reducing the weight ratio of phosphor/binder, by relatively increasing the size (mean particle size) of the phosphor particles, or by incorporating dyes absorbing the stimulating rays. These methods can be adopted singly or in combination. Further, a stimulating ray-absorbing thin film may be provided between the partition and the phosphor-incorporated areas.

The stimulable phosphor sheet of the invention can be produced, for example, in the following manner.

First, a large number of stimulable phosphor films for forming the stimulable phosphor-incorporated areas and a large number of stimulable or UV light-emitting phosphor films for forming the grid partition are independently produced. From thus produced films, the phosphor sheet of the invention can be produced by the layered composition-slicing method illustrated in FIGS. 3 to 9 described below.

Figure 3:
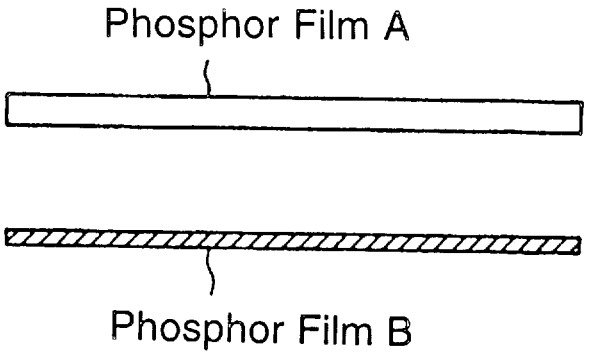
FIGS. 3 to 9 illustrate the steps of the process for producing the stimulable phosphor sheets of the invention. In the step shown in FIG. 3, stimulable phosphor films A (for forming the stimulable phosphor-incorporated areas) and stimulable phosphor films B (for forming the grid partition) are produced.
Figure 4:
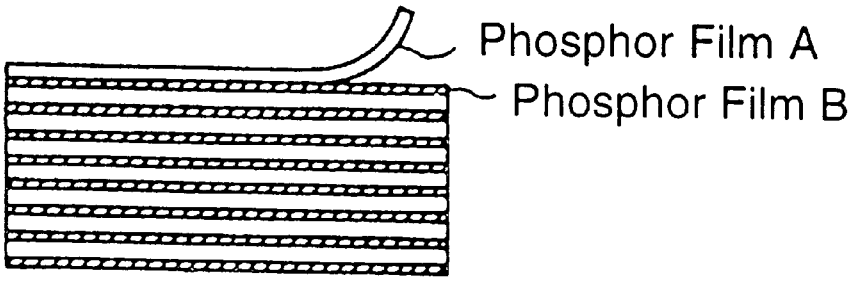

FIG. 3 shows the stimulable phosphor film for forming the stimulable phosphor-incorporated areas (hereinafter, referred to as "phosphor film A") and the stimulable or UV light-emitting phosphor film for forming the grid partition (hereinafter, referred to as "phosphor film B"). The film A comprises a stimulable phosphor and a binder, and the film B comprises a stimulable or UV light-emitting phosphor and a binder. As shown in FIG. 4, a large number of the films A and B are alternately piled up to give a multi-layered composition. The composition is then heated under pressure in the manner shown in FIG. 5, so that the neighboring A and B films would be placed in close contact with each other to form a multi-layered composition block.

Figure 6:
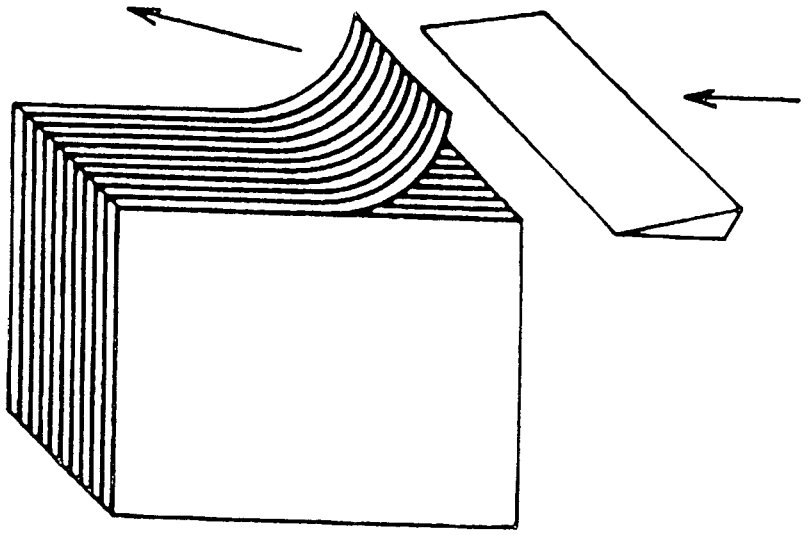
Figure 7:
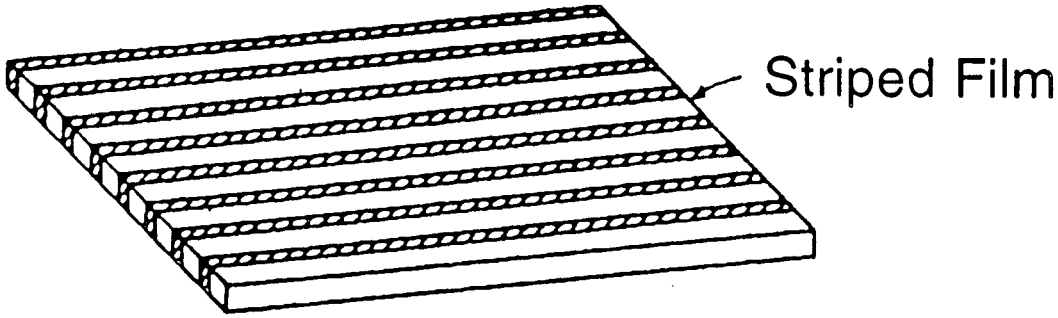

The composition block is sliced repeatedly in the direction perpendicular to the film plane as shown in FIG. 6, to prepare a large number of striped phosphor films shown in FIG. 7 in which strips of the films A and B are alternately placed.

Figure 5:
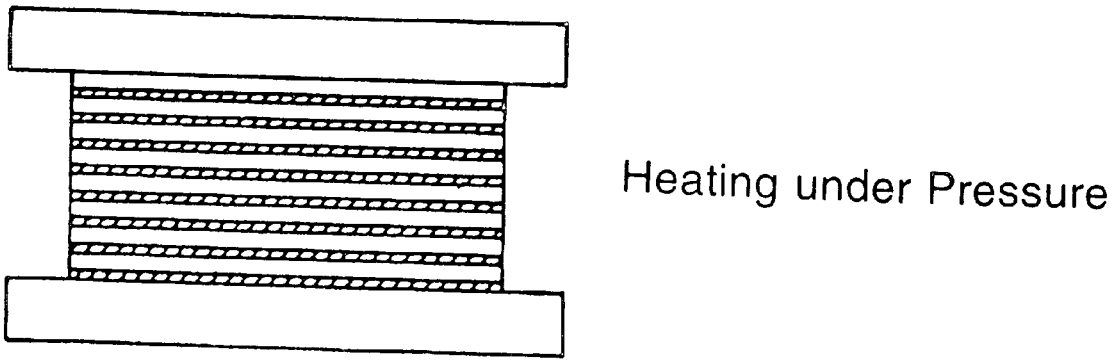
Figure 8:
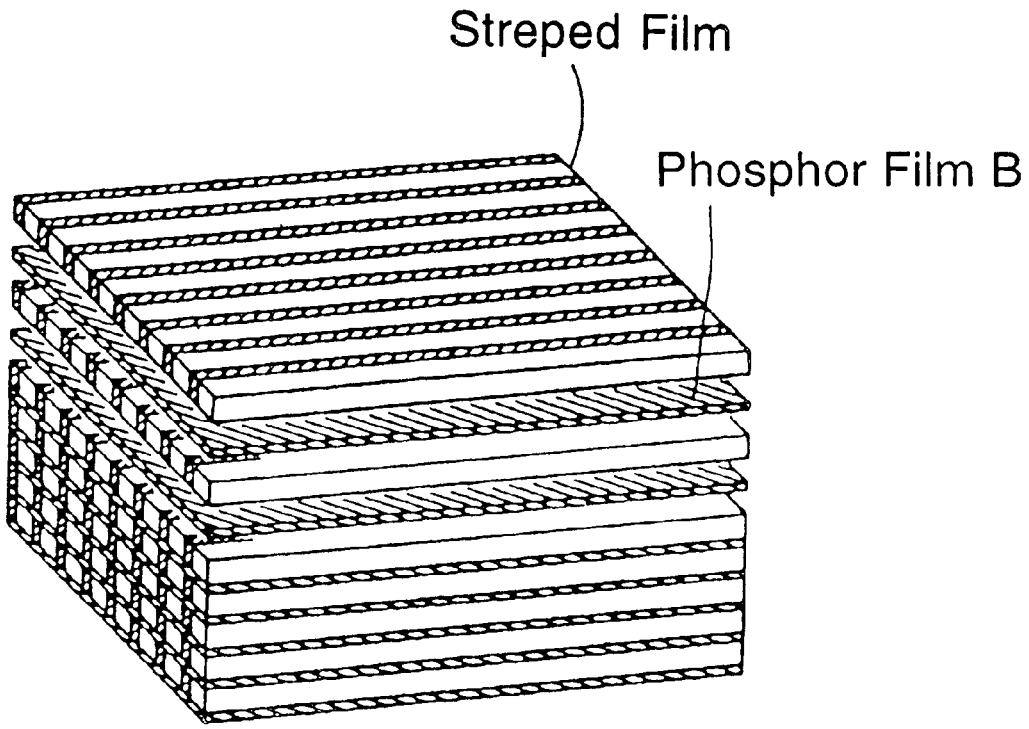
Figure 9:
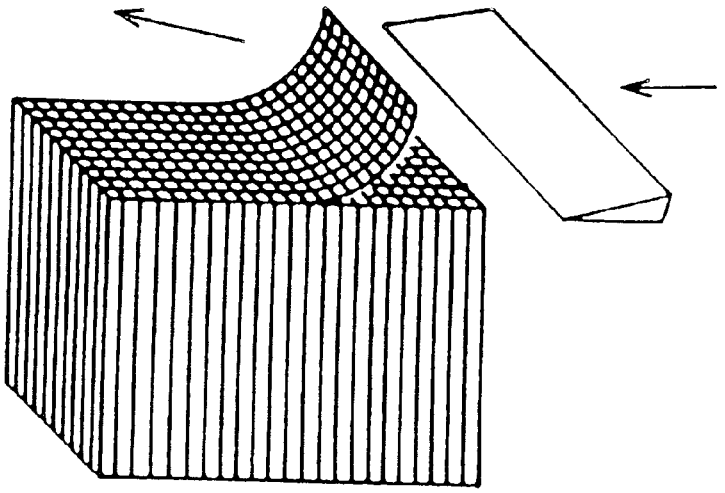

The striped phosphor films shown in FIG. 7 and the aforementioned films B (for forming the grid partition) are alternately piled up to form a multi-layered composition shown in FIG. 8. The composition is then heated under pressure in the same manner as shown in FIG. 5, to form a multi-layered composition block. Finally, the composition block of FIG. 8 is sliced repeatedly in the direction perpendicular to the film plane as shown in FIG. 9, so that the appearing face would comprise the end faces of the strips of the films. Thus, the stimulable phosphor sheet of the invention is produced.

On one surface of the sheet of the invention, a layer for reflecting the stimulating rays and/or the stimulated emission may be provided. However, if the phosphor sheet of the invention is to be used in a double-side reading system, it is preferred not to provide the reflecting layer.

The reflecting layer enhances the sensitivity of the stimulable phosphor sheet, and can comprise white pigments (e.g., titanium dioxide particles, barium sulfate particles) or non-stimulable phosphor particles (which exhibit no stimulated emission) dispersed in a binder. The stimulable phosphor sheet of the invention is preferably placed on a support. In this case, the reflecting layer is usually provided between the stimulable phosphor sheet and the support. In place of the reflecting layer, a stimulating ray-absorbing layer can be provided between them. The absorbing layer is effective for particularly improving the sharpness of the radiation image.

On the surface not facing the support, the stimulable phosphor sheet of the invention preferably has a protective film. In order not to affect the simulating rays or the stimulated emission, the film is preferably transparent. Further, for efficiently protecting the stimulable phosphor sheet from chemical deterioration and physical damage, the protective film should be both chemically stable and physically strong.

The protective film can be provided by fixing a beforehand prepared transparent plastic film on the stimulable phosphor sheet with adhesive, or by coating the phosphor sheet with absolution of protective film material and drying the coated solution. Into the protective film, fine particle filler may be incorporated so as to reduce blotches caused by interference and to improve the quality of the resultant image. Examples of preferable materials for the transparent plastic film include polyester resins (e.g., polyethylene terephthalate, polyethylene naphthalate), cellulose derivatives (e.g., cellulose triacetate), and various other resin materials such as polyolefin and polyamide. The thickness of the protective film is generally in the range of not more than 30 $\mu$m, preferably 1 to 15 $\mu$m, more preferably 5 to 12 $\mu$m.

For enhancing the resistance to staining, a fluororesin layer is preferably provided on the protective film. The fluororesin layer can be formed by coating the surface of the protective film with a solution of a fluororesin in an organic solvent, and drying the coated solution. The fluororesin may be used singly, but generally a mixture of the fluororesin and a film-forming resin is employed. In the mixture, an oligomer having polysiloxane structure or perfluoroalkyl group can be further added. The coating can be performed using known coating means such as doctor blade, roll coater, and knife coater. Into the fluororesin layer, fine particle filler may be incorporated so as to reduce blotches caused by interference and to improve the quality of the resultant image. The thickness of the fluororesin layer generally is in the range of 0.5 to 20 $\mu$m, preferably 1 to 5 $\mu$m. In the formation of the fluororesin layer, additives such as a crosslinking agent, a film-hardening agent and an anti-yellowing agent can be used. In particular, the crosslinking agent advantageously improves durability of the fluororesin layer.

The aforementioned layered composition-slicing method can be also advantageously employed for producing the sheet comprising a light-reflecting material-containing grid partition containing no phosphor. The method can be used for producing a stimulable phosphor sheet used in the radiation image recording and reproducing method comprising the steps of recording a radiographic image as a latent image, irradiating the latent image with stimulating rays to release stimulated emission, and electrically processing the emission to reproduce the radiation image; the sheet comprising a light-reflecting material-made grid partition two-dimensionally dividing the plane of the sheet into small rectangular sections, and stimulable phosphor-incorporated areas rectangularly sectioned with the grid partition. The light-reflecting material-made grid partition surrounds the phosphor-incorporated areas and reflects the stimulating rays and/or the stimulated emission, and hence encloses the rays and/or the emission in the phosphor-incorporated areas. Consequently, the partition prevents the stimulating rays and/or the stimulated emission from diffusing or scattering horizontally, so as to improve the sharpness of the resultant image.

When the stimulable phosphor sheet comprising a light-reflecting material-containing grid partition is produced by the slicing method, the procedure illustrated in FIGS. 3 to 9 is performed in the same manner except that light-reflecting material films are used in place of the phosphor films B.

As the light-reflecting material film, a film comprising light-reflecting particles and a binder is usually employed. Examples of the light-reflecting particles include white pigments such as titanium dioxide particles and barium sulfate particles, but they by no means restrict the invention. As the binder, various known materials described above are usable.

The stimulable phosphor sheet of the invention can be used either in a conventional single-side reading system (in which the stimulated emission is collected from the side having been exposed to the stimulating rays or from the other side) or in a known double-side reading system. The stimulable phosphor sheet of the invention is particularly effective in the double-side reading system.

EXAMPLE 1

1) Stimulable phosphor (BaFBr:Eu) particles (median of the particle sizes: 5 $\mu$m) and a thermoplastic high molecular weight-polyester resin were dispersed in an organic solvent in a weight ratio of 20:1. The prepared phosphor dispersion was coated on a temporary support having a releasing surface, and dried to give a dry phosphor layer. The phosphor layer thus formed was then peeled from the temporary support to give a stimulable phosphor film (1) (thickness: approx. 100 $\mu$m).

2) Stimulable phosphor (BaFBr:Eu) particles (median of the particle sizes: 5 $\mu$m), alumina particles (median of the particle sizes: 1 $\mu$m) and a thermoplastic high molecular weight-polyester resin were dispersed in an organic solvent in a weight ratio of 40:20:3. The prepared alumina-phosphor dispersion was coated onto a temporary support having a releasing surface, and dried to give a dry alumina-containing phosphor layer. The alumina-containing phosphor layer thus formed was then peeled from the temporary support to give an alumina-containing stimulable phosphor film (2) (thickness: approx. 30 $\mu$m).

3) Each of the stimulable phosphor film (1) and the alumina-containing stimulable phosphor film (2) was cut to give 350 square pieces (40 mm×40 mm). The pieces of the films (1) and (2) were alternately piled up to form a multi-layered composition consisting of 700 layers. The composition was then heated under pressure (pressure: approx. 1 kg/cm$^2$, temperature: 100° C.) for 1 hour to produce a multi-layered composition block (1).

4) The multi-layered composition block (1) was repeatedly sliced vertically to the layer plane with a wide microtome, to produce 200 sheets of striped phosphor film (3) (thickness: 100 $\mu$m).

50 200 sheets of the striped film (3) and 200 sheets of the alumina-containing film (2) were alternately piled up to form a multi-layered composition consisting of 400 layers. The composition was then heated under pressure (pressure: approx. 1 kg/cm$^2$, temperature: 100° C.) for 1 hour to produce a multi-layered composition block (2).

6) The multi-layered composition block (2) was sliced vertically to the layer plane with a wide microtome so that the appearing face would comprise the end faces of the strips, to produce a stimulable phosphor sheet (1) (thickness: approx. 215 μm) having a grid structure on the surface.

EXAMPLE 2

1) Stimulable phosphor (BaFBr:Eu) particles (median of the particle sizes: 5 μm), alumina particles (median of the particle sizes: 1 μm) and a thermoplastic high molecular weight-polyester resin were dispersed in an organic solvent in a weight ratio of 20:40:3. The prepared alumina-phosphor dispersion was coated on a temporary support having a releasing surface, and dried to form a dry alumina-containing phosphor layer. The alumina-containing phosphor layer thus formed was then peeled from the temporary support to give an alumina-containing stimulable phosphor film (4) (thickness: approx. 30 μm).

2) The procedure of Example 1 was repeated except for using the above-prepared alumina-containing stimulable phosphor film (4) in place of the alumina-containing phosphor film (2), to produce a stimulable phosphor sheet (2) (thickness: approx. 215 μm) having a grid structure on the surface.

EXAMPLE 3

1) Stimulable phosphor (BaFBr:Eu) particles (median of the particle sizes: 1 μm) and a thermoplastic high molecular weight-polyester resin were dispersed in an organic solvent in a weight ratio of 20:1. The prepared phosphor dispersion was coated on a temporary support having a releasing surface, and dried to form a dry phosphor layer. The layer thus formed was then peeled from the temporary support to give a stimulable phosphor film (5) (thickness: approx. 30 μm).

2) The procedure of Example 1 was repeated except for using the above-prepared stimulable phosphor film (5) in place of the alumina-containing phosphor film (2), to produce a stimulable phosphor sheet (3) (thickness: approx. 215 μm) having a grid structure on the surface.

EXAMPLE 4

1) Stimulable phosphor (BaFBr:Eu) particles (median of the particle sizes: 3 μm) and a thermoplastic high molecular weight-polyester resin were dispersed in an organic solvent in a weight ratio of 20:1. The prepared phosphor dispersion was coated on a temporary support having a releasing surface, and dried to form a dry phosphor layer. The phosphor layer thus formed was then peeled from the temporary support to give a stimulable phosphor film (6) (thickness: approx. 30 μm).

2) The procedure of Example 1 was repeated except for using the above-prepared stimulable phosphor film (6) in place of the alumina-containing phosphor film (2), to produce a stimulable phosphor sheet (4) (thickness: approx. 215 μm) having a grid structure on the surface.

EXAMPLE 5

1) Stimulable phosphor (BaFBr:Eu) particles (median of the particle sizes: 5 μm) and a thermoplastic high molecular weight-polyester resin were dispersed in an organic solvent in a weight ratio of 25:1. The prepared phosphor dispersion was coated on a temporary support having a releasing surface, and dried to form a dry phosphor layer. The phosphor layer thus formed was then peeled from the temporary support to give a stimulable phosphor film (7) (thickness: approx. 30 μm).

2) The procedure of Example 1 was repeated except for using the above-prepared stimulable phosphor film (7) in place of the alumina-containing phosphor film (2), to produce a stimulable phosphor sheet (5) (thickness: approx. 215 μm) having a grid structure on the surface.

EXAMPLE 6

1) Stimulable phosphor (BaFBr:Eu) particles (median of the particle sizes: 5 μm) and a thermoplastic high molecular weight-polyester resin were dispersed in an organic solvent in a weight ratio of 30:1. The prepared phosphor dispersion was coated on a temporary support having a releasing surface, and dried to form a dry phosphor layer. The phosphor layer thus formed was then peeled from the temporary support to give a stimulable phosphor film (8) (thickness: approx. 30 μm).

2) The procedure of Example 1 was repeated except for using the above-prepared stimulable phosphor film (8) in place of the alumina-containing phosphor film (2), to produce a stimulable phosphor sheet (6) (thickness: approx. 215 μm) having a grid structure on the surface.

EXAMPLE 7

1) Stimulable phosphor (BaFBr:Eu) particles (median of the particle sizes: 5 μm), ultramarine particles and a thermoplastic high molecular weight-polyester resin were dispersed in an organic solvent in a weight ratio of 40:0.2:3. The prepared dye-containing phosphor dispersion was coated on a temporary support having a releasing surface, and dried to form a dye/phosphor layer. The dye/phosphor layer thus formed was then peeled from the temporary support to give an ultramarine-containing stimulable phosphor film (9) (thickness: approx. 30 μm).

2) The procedure of Example 1 was repeated except for using the above-prepared stimulable phosphor film (9) in place of the alumina-containing phosphor film (2), to produce a stimulable phosphor sheet (7) (thickness: approx. 215 μm) having a grid structure on the surface.

EXAMPLE 8

1) UV light-emitting phosphor ($YTaO_4$) particles (median of the particle sizes: 1 μm) and a thermoplastic high molecular weight-polyester resin were dispersed in an organic solvent in a weight ratio of 20:1. The prepared phosphor dispersion was coated on a temporary support having a releasing surface, and dried to form a phosphor layer. The phosphor layer thus formed was then peeled from the temporary support to prepare a UV light-emitting phosphor film (10) (thickness: approx. 30 μm).

2) The procedure of Example 1 was repeated except for using the above-prepared UV light-emitting phosphor film (10) in place of the alumina-containing phosphor film (2), to produce a stimulable phosphor sheet (8) (thickness: approx. 215 μm) having a grid structure on the surface.

EXAMPLE 9

1) UV light-emitting phosphor ($GdF_3$) particles (median of the particle sizes: 1 μm) and a thermoplastic high molecular weight-polyester resin were dispersed in an organic solvent in a weight ratio of 20:1. The prepared phosphor dispersion was coated on a temporary support having a releasing surface, and dried to form a phosphor layer. The phosphor layer thus formed was then peeled from the temporary support to prepare a UV light-emitting phosphor film (11) (thickness: approx. 30 μm).

2) The procedure of Example 1 was repeated except for using the above-prepared UV light-emitting phosphor film (11) in place of the alumina-containing phosphor film (2), to produce a stimulable phosphor sheet (9) (thickness: approx. 215 μm) having a grid structure on the surface.

EXAMPLE 10

1) Stimulable phosphor ($YLuSiO_5$:Ce,Zr) particles (median of the particle sizes: 5 μm) and a thermoplastic high molecular weight-polyester resin were dispersed in an organic solvent in a weight ratio of 20:1. The prepared phosphor dispersion was coated on a temporary support having a releasing surface, and dried to form a phosphor layer. The phosphor layer thus formed was then peeled from the temporary support to give a stimulable phosphor film (12) (thickness: approx. 100 μm).

2) (UV light-emitting phosphor ($YTaO_4$) particles (median of the particle sizes: 1 μm) and a thermoplastic high molecular weight-polyester resin were dispersed in an organic solvent in a weight ratio of 20:1. The prepared phosphor dispersion was coated on a temporary support having a releasing surface, and dried to form a phosphor layer. The phosphor layer thus formed was then peeled from the temporary support to prepare a uv light-emitting phosphor film (13) (thickness: approx. 30 μm).

3) Each of the stimulable phosphor film (12) and the UV light-emitting phosphor film (13) was cut to give 350 square pieces (40 mm×40 mm). The pieces of the films (12) and (13) were alternately piled up to form a multi-layered composition consisting of 700 layers. The composition was then heated under pressure (pressure: approx. 1 kg/cm$^2$, temperature: 100° C.) for 1 hour to produce a multi-layered composition block (3).

4) The multi-layered composition block (3) was repeatedly sliced vertically to the layer plane with a wide microtome, to produce 200 sheets of striped phosphor film (14) (thickness: 100 μm).

5) 200 sheets of the striped film (14) and 200 sheets of the UV light-emitting phosphor film (13) were alternately piled up to give a multi-layered composition consisting of 400 layers. The composition was then heated under pressure (pressure: approx. 1 kg/cm$^2$, temperature: 100° C.) for 1 hour to produce a multi-layered composition block (4).

6) The multi-layered composition block (4) was sliced vertically to the layer plane with a wide microtome so that the appearing face would comprise the end faces of the strips, to produce a stimulable phosphor sheet (10) (thickness: 215 μm) having a grid structure on the surface.

EXAMPLE 11

1) UV-emitting phosphor ($GdF_3$) particles (median of the particle sizes: 1 μm) and a thermoplastic high molecular weight-polyester resin were dispersed in an organic solvent in a weight ratio of 20:1. The prepared phosphor dispersion was coated on a temporary support having a releasing surface, and dried to form a phosphor layer. The phosphor layer thus formed was then peeled from the temporary support to prepare a uv light-emitting phosphor film (15) (thickness: approx. 30 μm).

2) The procedure of Example 10 was repeated except for using the above-prepared UV light-emitting phosphor film (15) in place of the UV light-emitting phosphor film (13), to produce a stimulable phosphor sheet (11) (thickness: approx. 215 μm) having a grid structure on the surface.

EXAMPLE 12

1) Alumina particles (median of the particle sizes: 1 μm) and an acrylic polymer resin were dispersed in an organic solvent in a weight ratio of 20:1. The prepared alumina dispersion was coated on a temporary support having a releasable surface, and dried to form a phosphor layer. The phosphor layer thus formed was then peeled from the temporary support to prepare an alumina film (thickness: approx. 30 μm).

2) The procedure of Example 1 was repeated except for using the above-prepared alumina film in place of the alumina-containing phosphor film (2), to produce a stimulable phosphor sheet (12) (thickness: approx. 215 μm) having a grid structure on the surface.

EXAMPLE 13

The procedure of Example 10 was repeated except for using the alumina film produced in Example 12 in place of the UV emitting-emitting phosphor film (13), to produce a stimulable phosphor sheet (13) (thickness: approx. 215 μm) having a grid structure on the surface.

EXAMPLE 14

1) Stimulable phosphor (SrS:Ce,Sm) particles (median of the particle sizes: 5 μm) and a thermoplastic high molecular weight-polyester resin were dispersed in an organic solvent in a weight ratio of 20:1. The prepared phosphor dispersion was coated on a temporary support having a releasing surface, and dried to form a layer. The phosphor layer thus formed was then peeled from the temporary support to give a stimulable phosphor film (16) (thickness: approx. 100 μm).

2) UV light-emitting phosphor (BrFBr:Eu) particles (median of the particle sizes: 1 μm) and a thermoplastic high molecular weight-polyester resin were dispersed in an organic solvent in a weight ratio of 20:1. The prepared phosphor dispersion was coated on a temporary support having a releasing surface, and dried to form a phosphor layer. The phosphor layer thus formed was then peeled from the temporary support to give a UV light-emitting phosphor film (17) (thickness: approx. 30 μm)

3) Each of the stimulable phosphor film (16) and the UV light-emitting phosphor film (17) was cut to give 350 square pieces (40 mm×40 mm). The pieces of the films (16) and (17) were alternately piled up to form a multi-layered composition consisting of 700 layers. The composition was then heated under pressure (pressure: approx. 1 kg/cm$^2$, temperature: 100° C.) for 1 hour to produce a multi-layered composition block (7).

4) The multi-layered composition block (7) was repeatedly sliced vertically to the layer plane with a wide microtome, to produce 200 sheets of striped phosphor film (18)(thickness: 100 μm).

5) 200 sheets of the striped film (18) and 200 sheets of the UV-emitting phosphor film (17) were alternately piled up to form a multi-layered composition consisting of 400 layers. The composition was then heated under pressure (pressure: approx. 1 kg/cm$^2$, temperature: 100° C.) for 1 hour to produce a multi-layered composition block (8).

6) The multi-layered composition block (8) was sliced vertically to the layer plane with a wide microtome so that the appearing face would comprise the end faces of the strips, to produce a stimulable phosphor sheet (14) (thickness: 215 μm) having a grid structure on the surface.

EXAMPLE 15

1) UV light-emitting phosphor (BrFBr:Eu) particles (median of the particle sizes: 1 μm) and a thermoplastic high molecular weight-polyester resin were dispersed in an organic solvent in a weight ratio of 20:1. The prepared phosphor dispersion was coated on a temporary support having a releasing surface, and dried to form a phosphor layer. The phosphor layer thus formed was then peeled from the temporary support to prepare a UV light-emitting phosphor film (19) (thickness: approx. 30 μm).

2) The procedure of Example 14 was repeated except for using the above-prepared UV light-emitting phosphor film (19) in place of the UV light-emitting phosphor film (17), to produce a stimulable phosphor sheet (15) (thickness: approx. 215 μm) having a grid structure on the surface.

EXAMPLE 16

1) Alumina particles (median of the particle sizes: 1 μm) and an acrylic polymer resin were dispersed in an organic solvent in the weight ratio of 20:1. The prepared alumina dispersion was applied onto a temporary support having the surface beforehand subjected to releasing surface treatment, and dried to form a layer. The layer thus formed was then peeled from the temporary support to prepare an alumina film (thickness: approx. 30 μm).

2) The procedure of Example 14 was repeated except for using the above-prepared alumina film in place of the UV-emitting phosphor film (17), to produce a stimulable phosphor sheet (16) (thickness: approx. 215 μm) having a grid structure on the surface.

EXAMPLE 17

The procedure of Example 3 was repeated except that the ratio of phosphor/binder for the phosphor-incorporated area and that in the partition were set at 5/1 and 15/1, respectively, to produce a stimulable phosphor sheet (17) (thickness: approx. 215 μm) having a grid structure on the surface.

EXAMPLE 18

The procedures of Example 13 were repeated except that the ratio of phosphor/binder in the phosphor-incorporated area was set at 5/1 and the ratio of alumina/binder (acrylic resin) in the grid partition was set at 15/1, to produce a stimulable phosphor sheet (18) (thickness: approx. 215 μm) having a grid structure on the surface.

What is claimed is:

1. A stimulable phosphor sheet for a radiation image recording and reproducing method comprising the steps of recording a radiation image as a latent image, irradiating the latent image with stimulating rays to release stimulated emission, and electrically processing the emission to reproduce the radiation image, comprising a stimulable phosphor-containing grid partition that two-dimensionally divides the phosphor sheet on its plane to give plural small rectangular sections, and stimulable phosphor-incorporated areas which are rectangularly sectioned with the grid partition and which have a reflectance at the wavelength of the stimulating rays which differs from that of the grid partition.

2. The stimulable phosphor sheet of claim 1, which has a support provided on one surface side thereof and a transparent protective film provided on the other surface side.

3. The stimulable phosphor sheet of claim 1, wherein each of the stimulable phosphor-containing grid partition and the stimulable phosphor-incorporated area comprises stimulable phosphor particles and a binder.

4. A process for producing a stimulable phosphor sheet, which comprises the steps of:

(i) producing plural stimulable phosphor films A and plural stimulable phosphor films B having a reflectance at the wavelength of the stimulating rays which differs from that of the films A;

(ii) forming a multi-layered composition block in which the stimulable phosphor films A and the stimulable phosphor films B are alternately piled up under the condition that neighboring phosphor films A and B would be placed in close contact with each other;

(iii) repeatedly slicing the multi-layered composition block in the direction perpendicular to the plane of the piled films, to prepare plural striped phosphor films in which strips of the stimulable phosphor films A and B are alternately arranged;

(iv) forming another multi-layered composition block in which the striped phosphor films and the stimulable phosphor films B are alternately piled up under the condition that neighboring striped film and stimulable phosphor film B would be placed in close contact with each other; and (v) slicing repeatedly the multi-layered composition block formed in the step (iv) in the direction perpendicular to the plane of the piled films, so as to give a stimulable phosphor sheet which comprises a stimulable phosphor-containing grid partition two-dimensionally dividing the phosphor sheet on its plane to give plural small rectangular sections,.and stimulable phosphor-incorporated areas which are rectangularly sectioned with the grid partition and which have a reflectance at the wavelength of the stimulating rays which differs from that of the grid partition.

5. The process of claim 4, wherein each of the stimulable phosphor films A and B comprises stimulable phosphor particles and a binder.

6. The process of claim 4, wherein the multi-layered composition block of the step (ii) is prepared by alternately piling up the stimulable phosphor films A and the stimulable phosphor films B to form a multi-layered composition, and heating the composition under pressure.

7. The process of claim 4, wherein the multi-layered composition block of the step (iv) is prepared by alternately piling up the striped phosphor films and the stimulable phosphor films B to form a multi-layered composition, and heating the composition under pressure.

8. A stimulable phosphor sheet for a radiation image recording and reproducing method comprising the steps of recording a radiation image as a latent image, irradiating the latent image with stimulating rays to release stimulated emission, and electrically processing the emission to reproduce the radiation image, comprising a grid partition that contains a phosphor absorbing the radiation and emitting light in a UV or visible wavelength region and two-dimensionally divides the phosphor sheet on its plane to give plural small rectangular sections, and stimulable phosphor-incorporated areas which are rectangularly sectioned with the grid partition and which have a reflection property differing from that of the grid partition at the wavelength of the stimulating rays.

9. The stimulable phosphor sheet of claim 8, which has a support provided on one surface side thereof and a transparent protective film provided on the other surface side.

10. The stimulable phosphor sheet of claim 8, wherein the grid partition comprises phosphor particles absorbing the radiation and emitting light in a UV or visible wavelength region and a binder, and the stimulable phosphor-incorporated area comprises stimulable phosphor particles and a binder.

11. A process for producing a stimulable phosphor sheet, comprising the steps of:

(i) producing plural stimulable phosphor films A and plural phosphor films B which contain a phosphor absorbing the radiation and emitting light in a UV or visible wavelength region and which have a reflectance differing from that of the films A at the wavelength of the stimulating rays;

(ii) forming a multi-layered composition block in which the stimulable phosphor films A and the phosphor films B are alternately piled up under the condition that neighboring phosphor films A and B would be placed in close contact with each other;

(iii) repeatedly slicing the multi-layered composition block in the direction perpendicular to the plane of the piled films, to prepare plural striped phosphor films in which strips of the phosphor films A and B are alternately arranged;

(iv) forming another multi-layered composition block in which the striped phosphor films and the phosphor films B are alternately piled up under the condition that neighboring striped film and phosphor film B would be placed in close contact with each other; and (v) slicing repeatedly the multi-layered composition block formed in the step (iv) in the direction perpendicular to the plane of the piled films, so as to give a stimulable phosphor sheet which comprises a UV or visible light-emitting phosphor-containing grid partition two-dimensionally dividing the phosphor sheet on its plane to give plural small rectangular sections, and stimulable phosphor-incorporated areas which are rectangularly sectioned with the grid partition and which have a reflectance at the wavelength of the stimulating rays which differs from that of the grid partition.

12. The process of claim 11, wherein the stimulable phosphor-incorporated areas contain stimulable phosphor particles and a binder, and the phosphor-containing grid partition contains a binder and phosphor particles absorbing the radiation and emitting light in a UV or visible wavelength region.

13. The process of claim 11, wherein the multi-layered composition block of the step (ii) is prepared by alternately piling up the stimulable phosphor films A and the phosphor films B to form a multi-layered composition, and heating the composition under pressure.

14. The process of claim 11, wherein the multi-layered composition block of the step (iv) is prepared by alternately piling up the striped phosphor films and the phosphor films B to form a multi-layered composition, and heating the composition under pressure.

15. A process for producing a stimulable phosphor sheet, comprising the steps of:

(i) producing plural stimulable phosphor films A and plural reflective material films B;

(ii) forming a multi-layered composition block in which the stimulable phosphor films A and the reflective material films B are alternately piled up under the condition that neighboring films A and B would be placed in close contact with each other;

(iii) repeatedly slicing the multi-layered composition block in the direction perpendicular to the plane of the piled films, to prepare plural striped phosphor films in which strips of the films A and B are alternately arranged;

(iv) forming another multi-layered composition block in which the striped phosphor films and the reflective material films B are alternately piled up under the condition that neighboring striped film and film B would be placed in close contact with each other; and (v) slicing repeatedly the multi-layered composition block formed in the step (iv) in the direction perpendicular to the plane of the piled films, so as to give a stimulable phosphor sheet which comprises a reflective material-containing grid partition two-dimensionally dividing the phosphor sheet on its plane to give plural small rectangular sections, and stimulable phosphor-incorporated areas which are rectangularly sectioned with the grid partition.

16. The process of claim 15, wherein the stimulable phosphor-incorporated areas contain stimulable phosphor particles-and a binder, and the reflective material-containing grid partition contains a binder and reflective material particles.

17. The process of claim 15, wherein the multi-layered composition block of the step (ii) is prepared by alternately piling up the stimulable phosphor films A and the reflective material films B to form a multi-layered composition, and heating the composition under pressure.

18. The process of claim 15, wherein the multi-layered composition block of the step (iv) is prepared by alternately piling up the striped phosphor films and the reflective material films B to form a multi-layered composition, and heating the composition under pressure.

* * * * *